US007181151B2

(12) United States Patent
Konuma et al.

(10) Patent No.: US 7,181,151 B2
(45) Date of Patent: Feb. 20, 2007

(54) IMAGE PRINTING APPARATUS HAVING A HELP MESSAGE DISPLAY FUNCTION TO DISPLAY HELP MESSAGES CORRESPONDING TO ON-SCREEN INFORMATION

(75) Inventors: Shigeo Konuma, Tokyo (JP); Tadashi Tenda, Tokyo (JP); Kimikazu Saitou, Tokyo (JP)

(73) Assignee: Konica Minolta Business Technologies Inc., Tokyo (JP)

( * ) Notice: Subject to any disclaimer, the term of this patent is extended or adjusted under 35 U.S.C. 154(b) by 105 days.

(21) Appl. No.: 10/783,371

(22) Filed: Feb. 20, 2004

(65) Prior Publication Data

US 2004/0264993 A1 Dec. 30, 2004

(30) Foreign Application Priority Data

Jun. 25, 2003 (JP) ..... 2003-181404

(51) Int. Cl.
*G03G 15/00* (2006.01)

(52) U.S. Cl. ..... 399/81

(58) Field of Classification Search ..... 399/81; 345/336–338, 168, 184
See application file for complete search history.

(56) References Cited

U.S. PATENT DOCUMENTS 5,124,942 A * 6/1992 Nielsen et al. ..... 715/713
6,222,539 B1 * 4/2001 Watts ..... 715/708
6,332,062 B1 * 12/2001 Phillips et al. ..... 399/12
6,606,460 B2 * 8/2003 Konno ..... 399/9

FOREIGN PATENT DOCUMENTS

JP 62-003260 A 1/1987

* cited by examiner

*Primary Examiner*—Quana Grainger
(74) *Attorney, Agent, or Firm*—Frishauf, Holtz, Goodman & Chick, P.C.

(57) ABSTRACT

This invention is directed to an image printing apparatus including an image printing unit which prints an image on the basis of image data, a storage unit which stores information concerning details of a message for operating the image printing apparatus, and a display unit which displays the message and, when a message for which the information concerning the details of the message is stored in the storage unit is displayed, also displays identification information which indicates that the details of the message can be displayed. The image printing apparatus further includes a control unit which causes the display unit to display a message, and an operating unit which allows the user to perform input operation through a help key for selecting a help function. When causing the display unit to display a message, the control unit recognizes whether or not information concerning the details of the message is stored in the storage unit. Upon recognizing that the information is stored, the control unit causes the display unit to display identification information together with the message.

10 Claims, 12 Drawing Sheets

IMAGE PRINTING APPARATUS HAVING A HELP MESSAGE DISPLAY FUNCTION TO DISPLAY HELP MESSAGES CORRESPONDING TO ON-SCREEN INFORMATION

BACKGROUND OF THE INVENTION

1. Field of the Invention

The present invention relates to an image printing apparatus which prints an image on a sheet by, for example, electrophotography and a display control method for the apparatus.

2. Description of the Prior Art

An electrophotographic image printing apparatus such as a digital copying machine is known well, which forms a latent image by exposing the uniformly charged photosensitive layer of a photosensitive body to light, develops the latent image by making toner adhere to the photosensitive layer, and transfers the image onto a sheet, thus performing image printing.

Such an image printing apparatus has recently become increasingly multifunctional. Accordingly, the operation method and the like have become complicated, and so the user cannot memorize all the functions and sometimes needs to check an operation method or the like.

As an image printing apparatus becomes multifunctional, a so-called instruction manual, manual, or the like becomes large in volume. As a consequence, the user cannot easily consult the instruction manual. It is also very difficult for the user to find out necessary information.

In addition, when the user operates the image printing apparatus while looking at such a manual, the possibility of making an error in the operation of the apparatus increases because of, for example, difficulty in consulting the manual.

The invention disclosed in Japanese Unexamined Patent Publication No. 62-3260 has been made under such circumstances, and is designed to display an operation method in text form on the operation panel of an image printing apparatus, thereby allowing the user to reliably perform his/her desired operation without any confusion.

It is known that in a conventional image printing apparatus, a help function of explaining operation in the apparatus when a help key is pressed is provided for an operating unit having both the function of a display unit which displays information to a user and the function of an input unit which receives an input from the user. The help function of the conventional image printing apparatus will be described below with reference to FIGS. 1A and 1B and FIGS. 2A and 2B.

FIGS. 1A and 1B are views showing display examples on the operation panel of the conventional image printing apparatus. FIG. 1A is a view showing a display window before pressing of the help key. FIG. 1B is a view showing a display window after pressing of the help key.

FIGS. 2A and 2B are views showing display examples on the operation panel of the conventional image printing apparatus. FIG. 2A is a view showing another example of the display window after pressing of the help key. FIG. 2B is a view showing an example of the display window displayed when a hard key is selected in the display window shown in FIG. 2A.

Referring to FIGS. 1A and 1B and FIGS. 2A and 2B, reference numeral 200 denotes a display window. Referring to FIGS. 2A and 2B, reference numeral 201 denotes a button for selecting display of an explanation of the hard key provided in the image printing apparatus.

FIG. 1A shows a window for setting reading conditions for the operation of making the image printing apparatus read an original image. If the items displayed in the window 200 include any unclear item which demands an explanation, the user presses a help key (not shown).

When the help key is pressed while the window 200 in FIG. 1A is displayed, the window 200 switches to the window 200 which displays explanations of the respective items displayed in the window 200 in FIG. 1A.

Alternatively, when the user presses the help key, a help menu like the one shown in FIG. 2A can be displayed.

When the user presses a button assigned to one of the items in the window 200 of the help menu in FIG. 2A which corresponds contents which the user wants to know, the window 200 switches to the window 200 which displays an explanation of the item, as shown in FIG. 2B. FIG. 2B shows the display window 200 displayed when the user presses the button 201.

The following problems arise in the conventional image printing apparatus described above.

In the conventional image printing apparatus, when the user presses the help key, an explanation can be displayed to the user. However, since it is difficult for the user to specify information which he/she wants to know, information including explanations of various items like those shown in. FIG. 1B is displayed. That is, information which the user wants to know is not timely displayed. In addition, since explanations of various items are displayed in this manner, when such information is displayed within a limited display area, a sufficient explanation cannot be displayed.

Furthermore, in the prior art, as shown in FIGS. 2A and 2B, although explanations of buttons, functions, and the like which are provided in advance are displayed, no explanation is given to the user concerning the state of the image printing apparatus which changes with the progress of operation, i.e., the state in which no copying operation can be done even when the copy start button is pressed to copy an original. This leads to poor operability.

SUMMARY OF THE INVENTION

The present invention has been made in consideration of the above problems in the prior art, and has as its first object to provide an image printing apparatus which achieves an improvement in usability for a user. It is the second object of the present invention to provide an image printing apparatus which achieves an improvement in usability by providing a help for the user in accordance with the operation state of the apparatus. It is the third object of the present invention to provide an image printing apparatus which can shorten the time required to reach information which the user wants to know.

In order to achieve the above objects, according to the first aspect of the present invention, there is provided an image printing apparatus comprising an image printing unit which prints an image on the basis of image data, a storage unit which stores information concerning details of a message for operating the image printing apparatus, and a display unit which displays the message and, when a message for which the information concerning the details of the message is stored in the storage unit is displayed, displays identification information which indicates that the details of the message can be displayed.

According to the second aspect of the present invention, the image printing apparatus of the first aspect further comprises a control unit which causes the display unit to display the message, the storage unit stores the information concerning the details of the message in correspondence with information concerning the message, and the control unit recognizes whether or not information concerning the details of the message is stored in the storage unit, when causing the display unit to display the message, and causes the display unit to display identification information together with the message, when recognizing that the information is stored.

According to the third aspect of the present invention, in the image printing apparatus of the second aspect, the storage unit stores corresponding information which indicates that the information concerning the details of the message is stored in correspondence with the information concerning the message, and the control unit recognizes on the basis of the corresponding information whether or not the information concerning the details of the message is stored in the storage unit.

According to the fourth aspect of the present invention, the image printing apparatus of the second aspect further comprises an operating unit having a help key which is operated by a user to instruct the display unit to display a help message, the control unit changes display contents on the display unit when the operating unit is operated, and the identification information is information for identifying each of a plurality of messages displayed by the designating unit as a message for which whether or not the information concerning the details of the message can be displayed on the display unit.

According to the fifth aspect of the present invention, in the image printing apparatus of the fourth aspect, the control unit causes the display unit to display the details of the message on the basis of the information concerning the details of the message when the help key is operated while the identification information is displayed on the display unit together with the message.

According to the sixth aspect of the present invention, in the image printing apparatus of the fourth aspects the message is displayed on the display unit together with a setting window for setting a condition for formation of the image, and the control unit causes the display unit to display details of the message on the basis of information concerning the details of the message when the help key is operated while the identification information is displayed, and causes the display unit to display the details of the setting window when the help key is operated while the identification information is not displayed on the display unit together with the message.

According to the seventh aspect of the present invention, in the image printing apparatus of the fourth aspect, the message is displayed on the display unit together with a setting window for setting a condition for formation of the image, and the control unit causes the display unit to display information concerning details of the message when the help key is operated while the identification information is displayed, and causes the display unit to display detailed information concerning the setting window when the help key is operated while the identification information is not displayed on the display unit, and the detailed information concerning the setting window is stored in the storage unit.

According to the eighth aspect of the present invention, in the image printing apparatus of the seventh aspect, the storage unit stores the detailed information concerning the setting window in correspondence with the information concerning the setting window, and the control unit determines whether or not the detailed information concerning the setting window is stored in the storage unit, when the help key is operated while the identification information is not displayed on the display unit, and causes the display unit to display the setting window, when determining that the detailed information is stored in the storage unit.

According to the ninth aspect of the present invention, in the image printing apparatus of the fifth aspect, the message and the details of the message are an operation instruction for the user and details of the operation instruction, respectively, and the control unit causes the display unit to display the details of the operation instruction when the help key is operated while the identification information is displayed on the display unit together with the operation instruction for the user.

According to the 10th aspect of the present invention, in the image printing apparatus of the fifth aspect, the message and the details of the message are a message stating that image printing cannot be started and details indicating that image printing cannot be started, respectively, and the control unit causes the display unit to display details indicating that the image printing cannot be started, when the help key is operated while the identification information is displayed on the display unit together with the message stating that the image printing cannot be started.

According to the 11th aspect of the present invention, there is provided an image printing apparatus comprising an image printing unit which prints an image on the basis of image data, an operating unit operated by a user, a display unit which changes display contents when the operating unit is operated, and a control unit which controls the display unit, wherein the operating unit includes a help key for selecting a help function, and the control unit causes the display unit to display details indicating that image printing cannot be started, when the help key is operated while a message stating that image printing cannot be started is displayed on the display unit.

According to the 12th aspect of the present invention, there is provided an image printing apparatus comprising an image printing unit which prints an image on the basis of image data, an operating unit operated by a user, a display unit which changes display contents when the operating unit is operated, and a control unit which controls the display unit, wherein the operating unit includes a help key for selecting a help function, and the control unit causes the display unit to display details of an instruction operation for the user, when the help key is operated while message indicating the operation instruction for the user is displayed on the display unit.

According to the 13th aspect of the present invention, there is provided an image printing apparatus comprising an image printing unit which prints an image on the basis of image data, an operating unit operated by a user, a display unit which displays a setting window for setting a condition for formation of the image together with a message, a storage unit which stores information concerning details of the message, and a control unit which controls the display unit, wherein the operating unit includes a help key for selecting a help function, and the control unit causes the display unit to display the details of the message, if information concerning the details of the message corresponding to the message displayed on the display unit is stored in the storage unit when the help key is operated, and causes the display unit to display details of the setting window if information concerning the details of the message corresponding to the message displayed on the display unit is not stored in the storage unit.

According to the 14th aspect of the present invention, there is provided an image printing apparatus comprising an image printing unit which prints an image on a sheet on the basis of image data, a control unit which controls operation of the image printing apparatus, an operating unit which allows the user to perform input operation, and an display unit which changes a display window in accordance with a key input, wherein the operating unit includes a help key for allowing the user to select a help function, and the control unit controls the display unit to display details indicating that image printing cannot be started, when the help function is selected by the help key while the display unit is displaying information indicating that the image printing cannot be started.

According to the 15th aspect of the present invention, there is provided an image printing apparatus comprising an image printing unit which prints an image on a sheet on the basis of image data, a control unit which controls operation of the image printing apparatus, an operating unit which allows the user to perform input operation, and a display unit which changes a display window in accordance with a key input, wherein the operating unit includes a help key for allowing the user to select a help function, and the control unit controls the display unit to display details of an operation instruction for the user, when the help function is selected by the help key while the display unit is displaying information for the operation instruction for the user.

According to the 16th aspect of the present invention, there is provided an image printing apparatus comprising an image printing unit which prints an image on a sheet on the basis of image data, a control unit which controls operation of the image printing apparatus, an operating unit which allows the user to perform input operation, and a display unit which changes a display window in accordance with a key input, wherein the operating unit includes a help key for allowing the user to select a help function, and the control unit controls the display unit to display identification information for allowing the user to identify each of a plurality of messages displayed on the display unit as a message for which whether or not details of the message can be displayed through the help function.

According to the 17th aspect of the present invention, there is provided a display control method for an image printing apparatus including an image printing unit which prints an image on a sheet on the basis of image data, a control unit which controls operation of the image printing apparatus, an operating unit which allows the user to perform input operation, and a display unit which changes a display window in accordance with a key input, the operating unit including a help key for allowing the user to select a help function, comprising, when the help function is selected by the help key while the display unit is displaying information indicating that image printing cannot be started is displayed, controlling the display unit to display details indicating that the image printing cannot be started.

According to the 18th aspect of the present invention, there is provided a display control method for an image printing apparatus including an image printing unit which prints an image on a sheet on the basis of image data, a control unit which controls operation of the image printing apparatus, an operating unit which allows the user to perform input operation, and a display unit which changes a display window in accordance with a key input, the operating unit including a help key for allowing the user to select a help function, comprising, when the help function is selected by the help key while the display unit is displaying an operation instruction for the user, controlling the display unit to display details of an operation instruction for the user.

According to the 19th aspect of the present invention, there is provided a display control method for an image printing apparatus including an image printing unit which prints an image on a sheet on the basis of image data, a control unit which controls operation of the image printing apparatus, an operating unit which allows the user to perform input operation, and a display unit which changes a display window in accordance with a key input, the operating unit including a help key for allowing the user to select a help function, comprising controlling the display unit to display identification information for allowing the user to identify each of a plurality of messages displayed by the display unit as a message for which whether or not details of the message can be displayed through the help function.

As is obvious from the respective aspects described above, according to the present invention, when a message for which information concerning the details of the message is stored in the storage unit is to be displayed, identification information indicating that the details of the message can be displayed is displayed. This makes it possible to provide an image printing apparatus which has achieved an improvement in usability for the user.

When the help key is operated while a message stating that image printing cannot be started is displayed, the details of the message are displayed. This makes it possible to provide an image printing apparatus which has achieved an improvement in usability by providing the user with a help corresponding to the operation state of the image printing apparatus.

When the help key is operated while a message indicating an operation instruction is displayed to the user, the details of the operation instruction are displayed to the user. This makes it possible to provide an image printing apparatus which can shorten the time required to reach information which the user wants to know.

The above and many other objects, features and advantages of the present invention will become manifest to those skilled in the art upon making reference to the following detailed description and accompanying drawings in which a preferred embodiment incorporating the principle of the present invention is shown by way of illustrative examples.

BRIEF DESCRIPTION OF THE DRAWINGS

FIGS. 1A and 1B show display examples on the operation panel of a conventional image printing apparatus, in which FIG. 1A is a view showing an example of the display window displayed before the help key is pressed, and FIG. 1B is a view showing an example of the display window displayed after the help key is pressed;

FIGS. 2A and 2B show display examples on the operation panel of the conventional image printing apparatus, in which FIG. 2A is a view showing another example of the display window displayed after the help key is pressed, and FIG. 2B is an example of the display window displayed when a hard key is selected in the display window shown in FIG. 2A;

DETAILED DESCRIPTION OF THE PREFERRED EMBODIMENT

A preferred embodiment of the present invention will be described below with reference to the accompanying drawings.

Figure 1A:
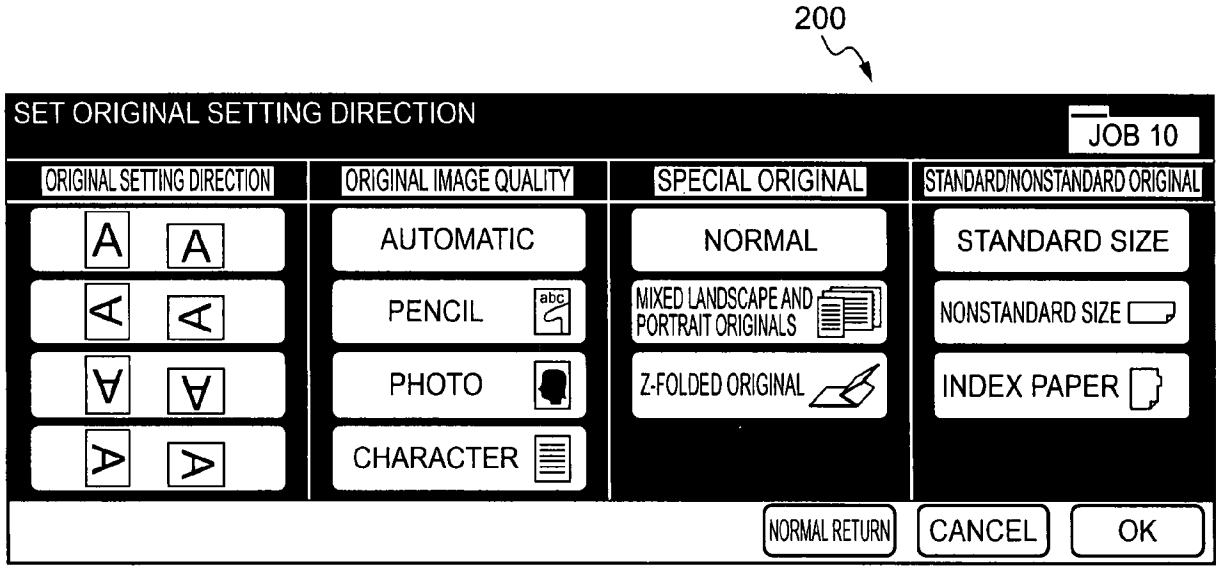
FIG. 1A PRIOR ART
Figure 1B:
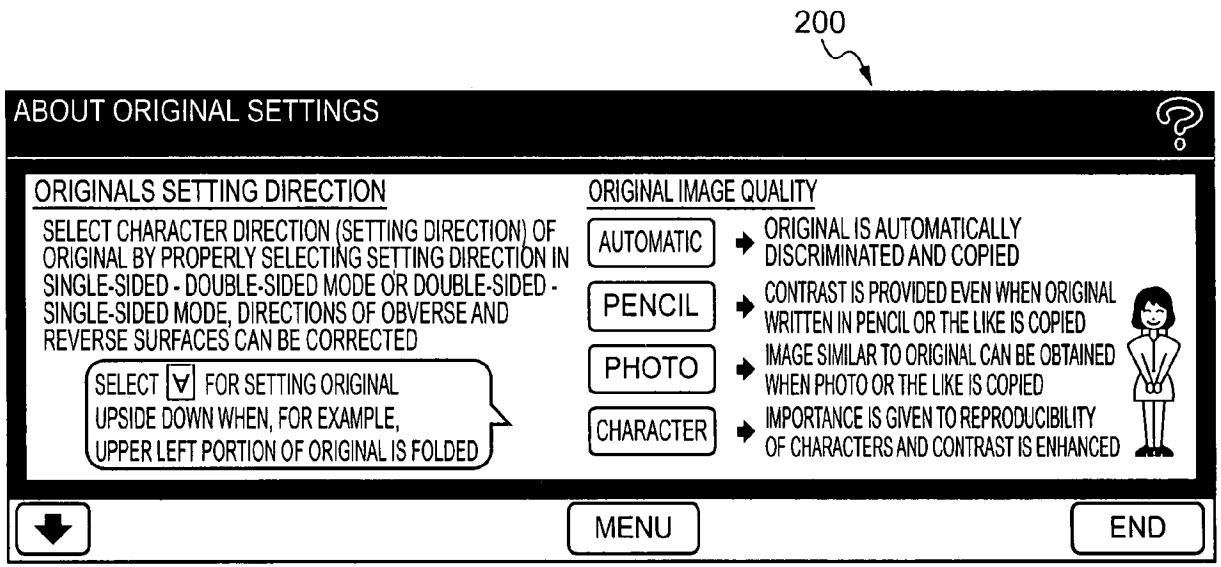
FIG. 1B PRIOR ART
Figure 2A:
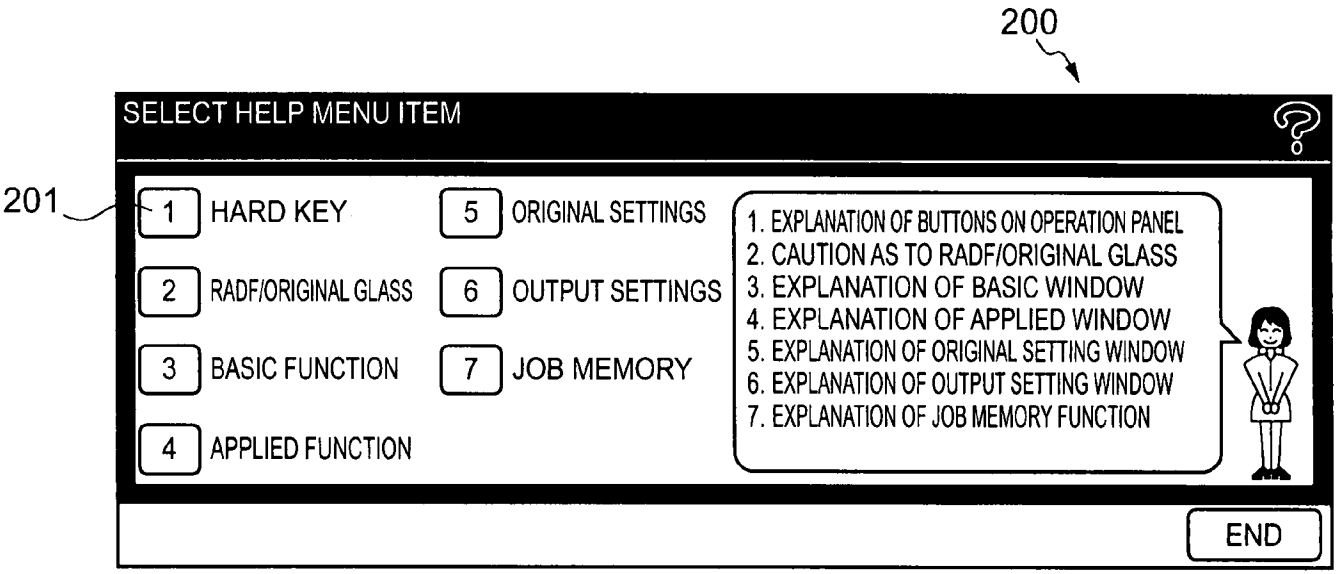
FIG. 2A PRIOR ART
Figure 2B:
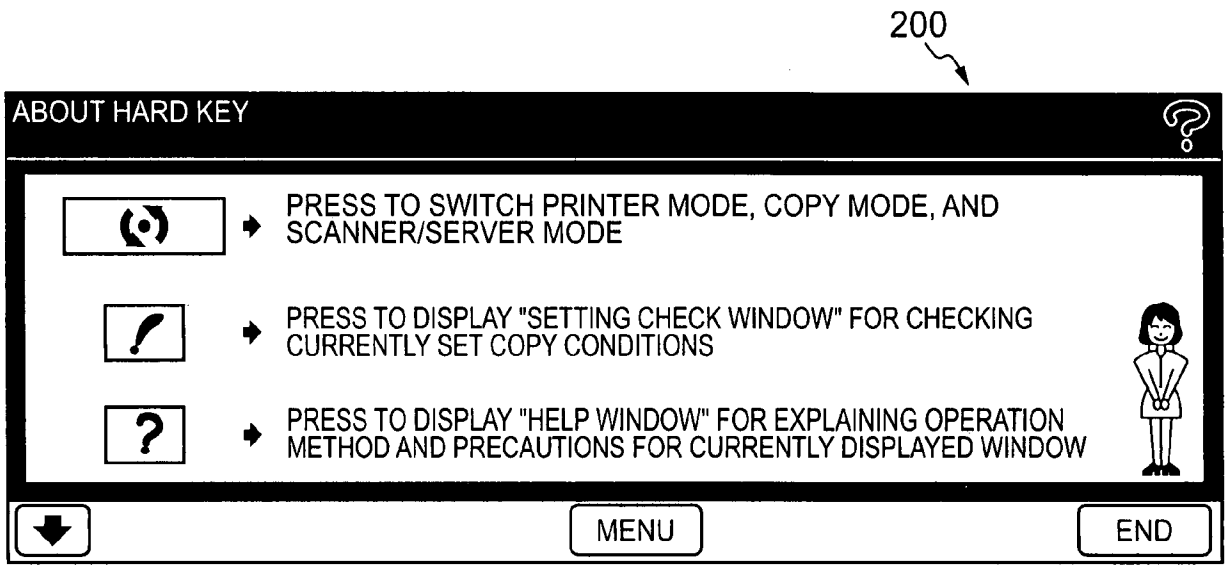
FIG. 2B PRIOR ART
Figure 3:
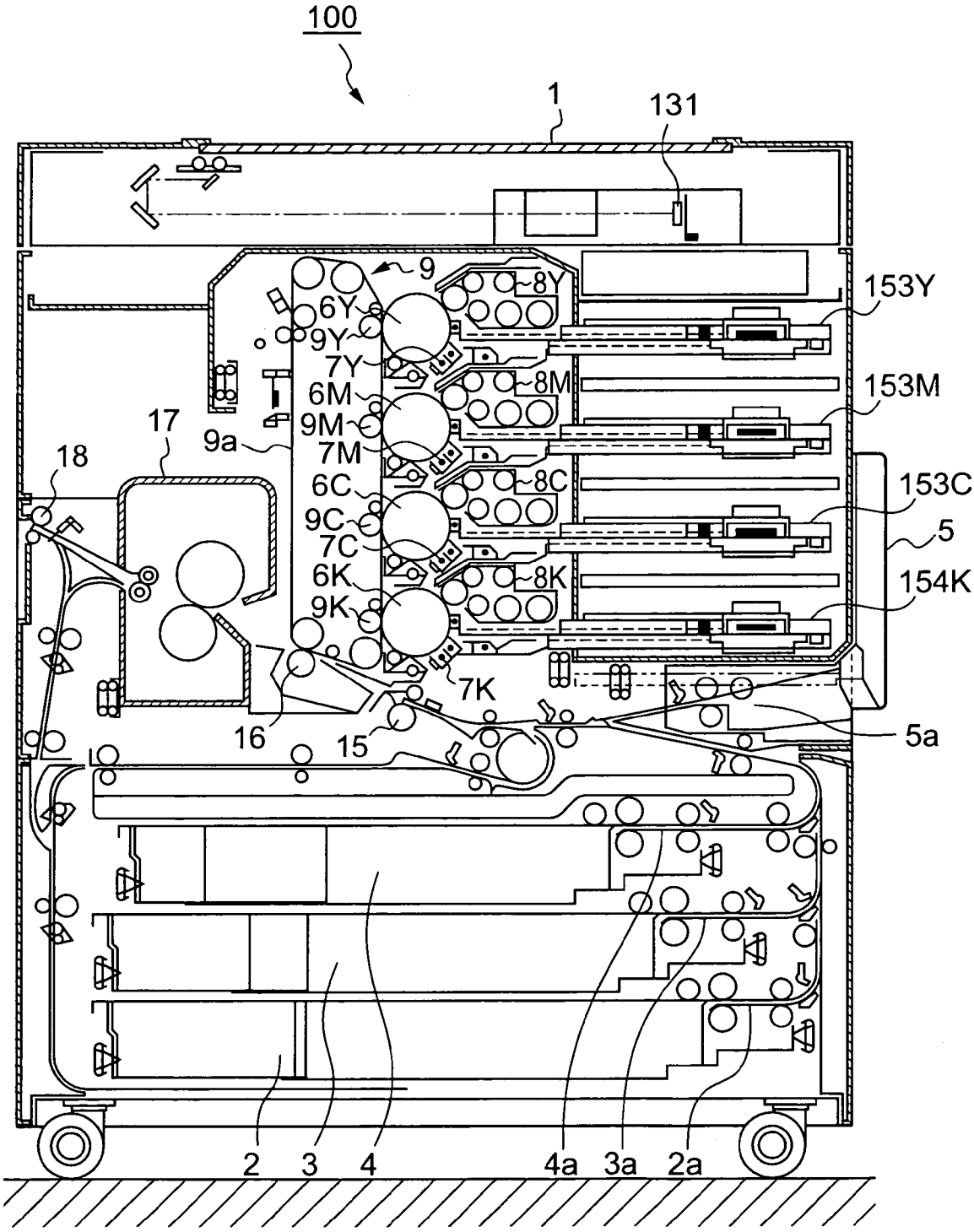
FIG. 3 is a schematic sectional view showing the arrangement of an electrophotographic copying machine as an embodiment of an embodiment of the present invention.

FIG. 3 is a schematic sectional view showing the arrangement of an image printing apparatus according to an embodiment of the present invention. An electrophotographic copying machine will be described as the image printing apparatus according to the embodiment of the present invention.

The arrangement and basic operation of an image printing apparatus 100 according to this embodiment will be described with reference to FIG. 3.

Although an image printing apparatus capable of printing color images will be described in this embodiment, it is obvious that the present invention is not limited to this, and can be applied to an image printing apparatus capable of printing only monochrome images.

The image printing apparatus 100 includes a plurality of document writing units 153Y, 153M, and 153C for a color image printing unit, and a document writing unit 154K for a monochrome image printing unit. The document writing unit 153Y can form yellow images; the document writing unit 153M, magenta images; the document writing unit 153C, cyan images, and the document writing unit 154K, black images.

This apparatus includes photosensitive bodies 6Y, 6M, 6C, and 6K, charging units 7Y, 7M, 7C, and 7K, and developing units 8Y, 8M, 8C, and 8K in correspondence with the document writing units 153Y, 153M, 153C, and 154K. The apparatus also includes an intermediate transfer unit 9 common to the above color image printing unit and monochrome image printing unit. The intermediate transfer unit 9 includes an intermediate transfer body 9*a* in the form of an endless belt which is wound around a plurality of rollers and is so placed as to be able to come into contact with the photosensitive bodies 6Y, 6M, 6C, and 6K, and primary transfer units 9Y, 9M, 9C, and 9K which make the intermediate transfer body 9*a* come into contact with the photosensitive bodies 6Y, 6M, 6C, and 6K to transfer images.

Other components will be described next. An original reading unit 1 functioning as a scanner unit is mounted on the upper portion side of the image printing apparatus 100. An original is set on a glass surface as a platen. The original reading unit 1 then reads the original. The original reading unit 1 incorporates a CCD 131 to which reflected light obtained by the above scanning operation is input. Although not shown in FIG. 3, the original reading unit may include an ADF (Automatic Document Feeder).

Paper trays 2, 3, and 4 are arranged in the lower portion of the image printing apparatus 100, and paper feed units 2*a*, 3*a*, and 4*a* are respectively provided for the paper trays. A manual paper tray 5 is provided in an outer side wall portion of the image printing apparatus 100. A paper feed unit 5*a* is provided for the manual paper tray 5. Since a plurality of types of paper trays and manual paper tray are provided in this manner, a plurality of types of sheets having different sizes can be used.

Registration rollers 15 are arranged ahead of the paper feed side of the paper feed units 2*a* to 5*a*. A secondary transfer roller 16 which can press a sheet against the intermediate transfer body 9*a* is placed ahead of the registration rollers 15. A fixing unit 17 is placed ahead of the secondary transfer roller 16. Delivery rollers 18 are provided ahead of the fixing unit 17.

In the image printing apparatus 100, in accordance with an image printing command, when color printing is performed, the images formed as needed by the document writing units 153Y, 153M, 153C, and 154K are transferred onto the intermediate transfer body 9*a* by the photosensitive bodies 6Y, 6M, 6C, and 6K, charging units 7Y, 7M, 7C, and 7K, developing units 8Y, 8M, 8C, and 8K, and primary transfer units 9Y, 9M, 9C, and 9K. When monochrome printing is performed, the image formed by the document writing unit 154K is transferred onto the intermediate transfer body 9*a* by the photosensitive body 6K, charging unit 7K, developing unit 8K, and primary transfer unit 9K.

A sheet necessary for image printing is fed from one of the paper trays 2, 3, and 4 or the manual paper tray 5 in accordance with the paper size or the like by a corresponding one of the paper feed units 2*a*, 3*a*, 4*a*, and 5*a*. The sheet then reaches the secondary transfer roller 16 through the registration rollers 15. The sheet is pressed against the intermediate transfer body 9*a* by the secondary transfer roller 16, and the image on the intermediate transfer body 9*a* is transferred onto the sheet. The fixing unit 17 fixes the transferred image on the sheet. The sheet is then delivered out of the image printing apparatus 100 through the delivery rollers 18.

Figure 4:
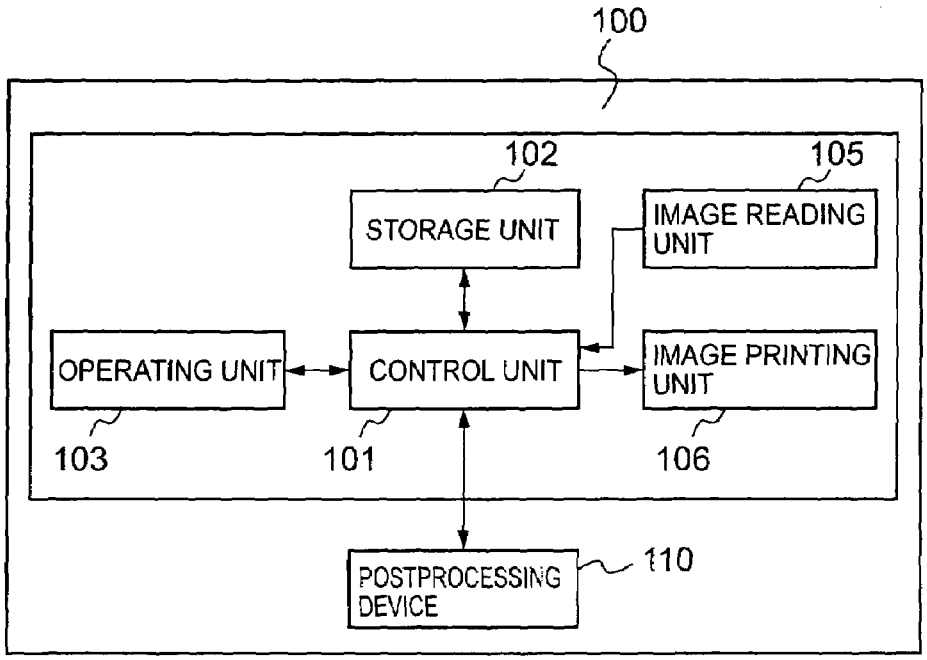
FIG. 4 is a block diagram showing constituent elements which controls the image printing apparatus shown in FIG. 3.

FIG. 4 is a block diagram showing an arrangement for control on the image printing apparatus 100 in FIG. 3.

As shown in FIG. 4, the image printing apparatus 100 is comprised of a control unit 101 which performs overall control on the image printing apparatus 100, an image reading unit 105 which has the original reading unit 1 and reads an image from an original, an image printing unit 106 which has the document writing units 153Y, 153M, 153C, and 154K and prints images on image printing sheets like a paper sheet, a storage unit 102 which stores the image data and the like read by the image reading unit 105, the programs to be executed by the control unit 101, parameters necessary for the operation of the image printing apparatus 100, and the like, an operating unit 103 which displays information from the image printing apparatus 100 to the user and allows the user to input operations, instructions, and the like to the image printing apparatus 100, and a postprocessing device 110 which, for examples, staples sheets on which images are printed and forms holes for filing.

The operating unit 103 is comprised of, for example, a touch panel type operation panel 115 (to be described later) and a fixed button type operating unit (not shown). In this embodiment, a help key (not shown) which is used by the user to select a help function is provided on the fixed button type operating unit. However, a help key may be provided on the operation panel 115.

The operating unit 103 may include a display panel unit such as a CRT, liquid crystal display, or EL display and an input device unit such as a touch panel or mouse which detects a coordinate position corresponding to a button position on the display panel.

The operation of this embodiment will be described in detail next with reference to the accompanying drawings.

Figure 5:
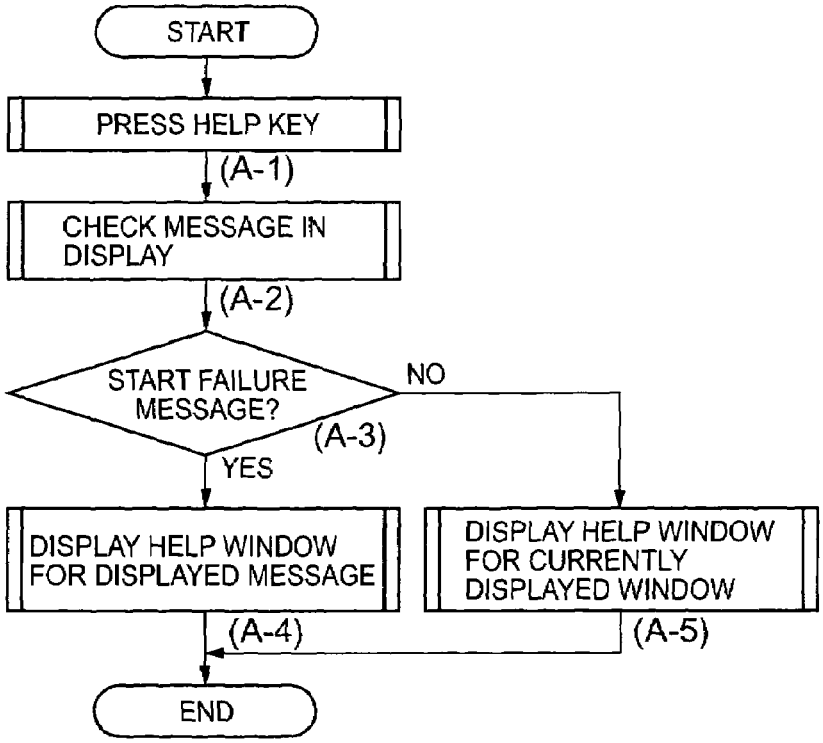
FIG. 5 is a flow chart showing an example of an operation sequence for help function processing in the image printing apparatus shown in FIG. 3.

FIG. 5 is a flow chart showing an example of the processing operation of the help function in the image printing apparatus 100 shown in FIG. 3.

The control unit 101 of the image printing apparatus 100 detects that the help key is pressed by the user on the operating unit 103 (A-1).

Upon detecting that the help key is pressed by the user, the control unit 101 checks the message currently displayed on the operation panel 115 of the operating unit 103 (A-2).

The control unit 101 then checks whether or not the currently displayed message is a "start disable message", e.g., a message stating that copying operation cannot be started is displayed even when the user has issued an instruction to start copying operation by using the operating unit 103, or a message stating that image printing cannot be started is displayed (A-3).

If the "start disable message" is currently displayed, a help window as an explanation of the currently displayed "start disable message" is displayed on the operating unit 103 (A-4). The contents to be displayed may be stored in the storage unit 102 in advance to be read out as needed.

If it is determined in step (A-3) that the "start disable message" is not currently displayed, a help window as an explanation of the currently displayed window is displayed on the operating unit 103 (A-5). The contents to be displayed in this step may also be stored in the storage unit 102 in advance to be read out as needed.

The operation processing in this embodiment in a situation different from that shown in FIG. 5 will be described next.

Figure 6:
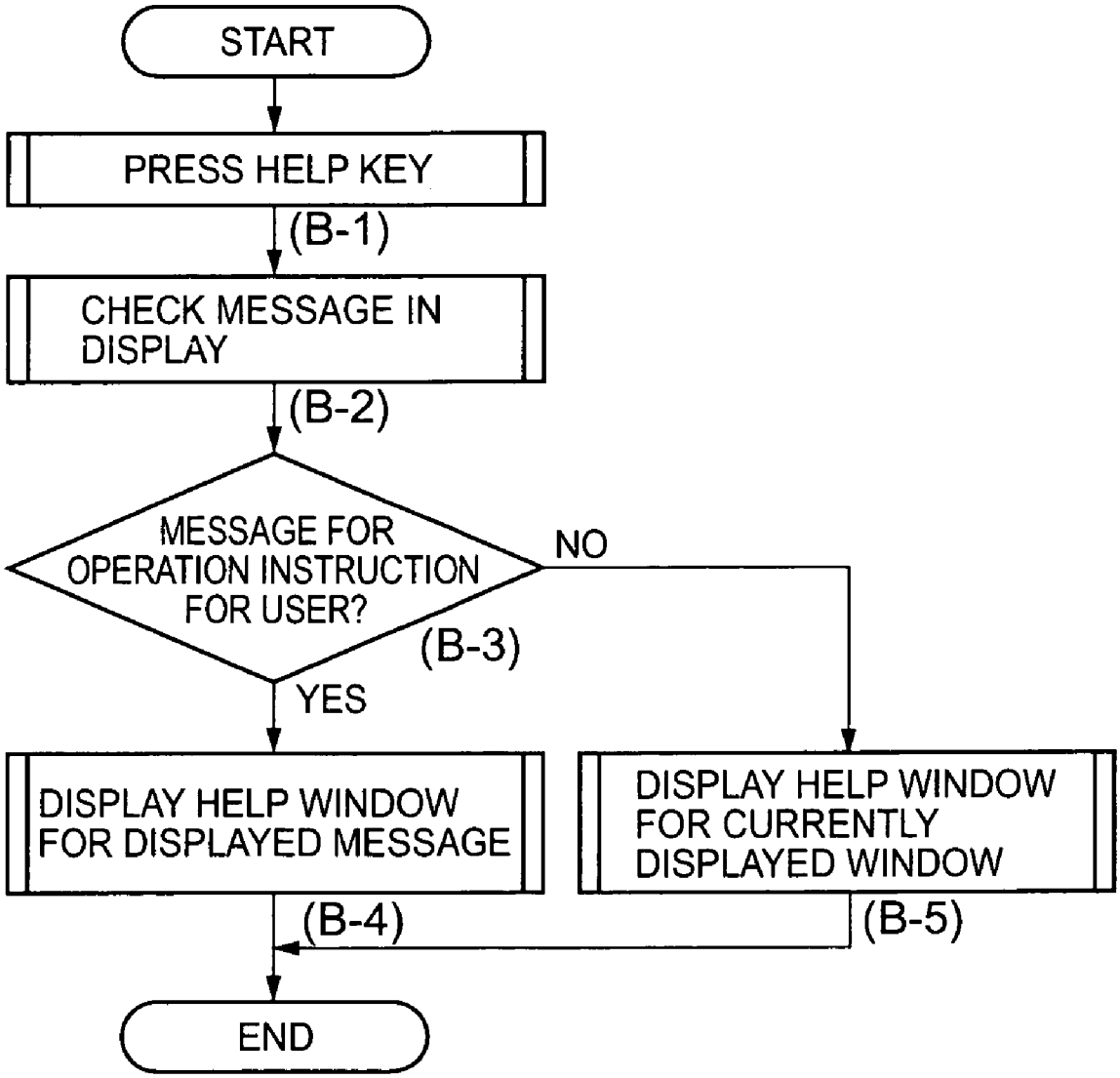
FIG. 6 is a flow chart showing another example of the operation sequence for the help function processing in the image printing apparatus shown in FIG. 3.

FIG. 6 is a flow chart showing an example of the processing sequence of the help function in the image printing apparatus 100 in this embodiment shown in FIG. 3, which is different from the example shown in FIG. 5.

The control unit 101 of the image printing apparatus 100 detects that the help key is pressed by the user on the operating unit 103 (B-1).

Upon detecting that the help key is pressed by the user, the control unit 101 checks the message currently displayed on the operation panel 115 of the operating unit 103 (B-2)

The control unit 101 then checks whether the currently displayed message is a "operation instruction message to user", i.e., whether a message for operation instruction is currently displayed, e.g., a message instructing the user to open/close the door of the image printing apparatus 100 because of paper jam or the like, a message notifying the user of an operation sequence, or a message prompting the user to change the operation (B-3) Note that this determination is made by, for example, checking whether or not a help window is stored in advance in correspondence with the currently displayed message.

If the "operation instruction message to user" is currently displayed, a help window which is an explanation of the currently displayed "operation instruction message to user" and is information concerning the details of the message is displayed on the operating unit 103 (B-4). The information concerning the details of the message may be stored in the storage unit 102 in advance in correspondence with the message to be read out as needed.

If it is determined in step (B-3) that the "operation instruction message to user" is not currently displayed, i.e., a message for which no help function is prepared is currently displayed, a help window as an explanation of the currently displayed window is displayed on the operating unit 103 (B-5). The help window as the explanation of the currently displayed window may be stored in the storage unit 102 in advance in correspondence with the information concerning the currently displayed set window to be read out as needed.

The operation of this embodiment in a situation still different from those shown in FIGS. 5 and 6 will be described next.

Figure 7:
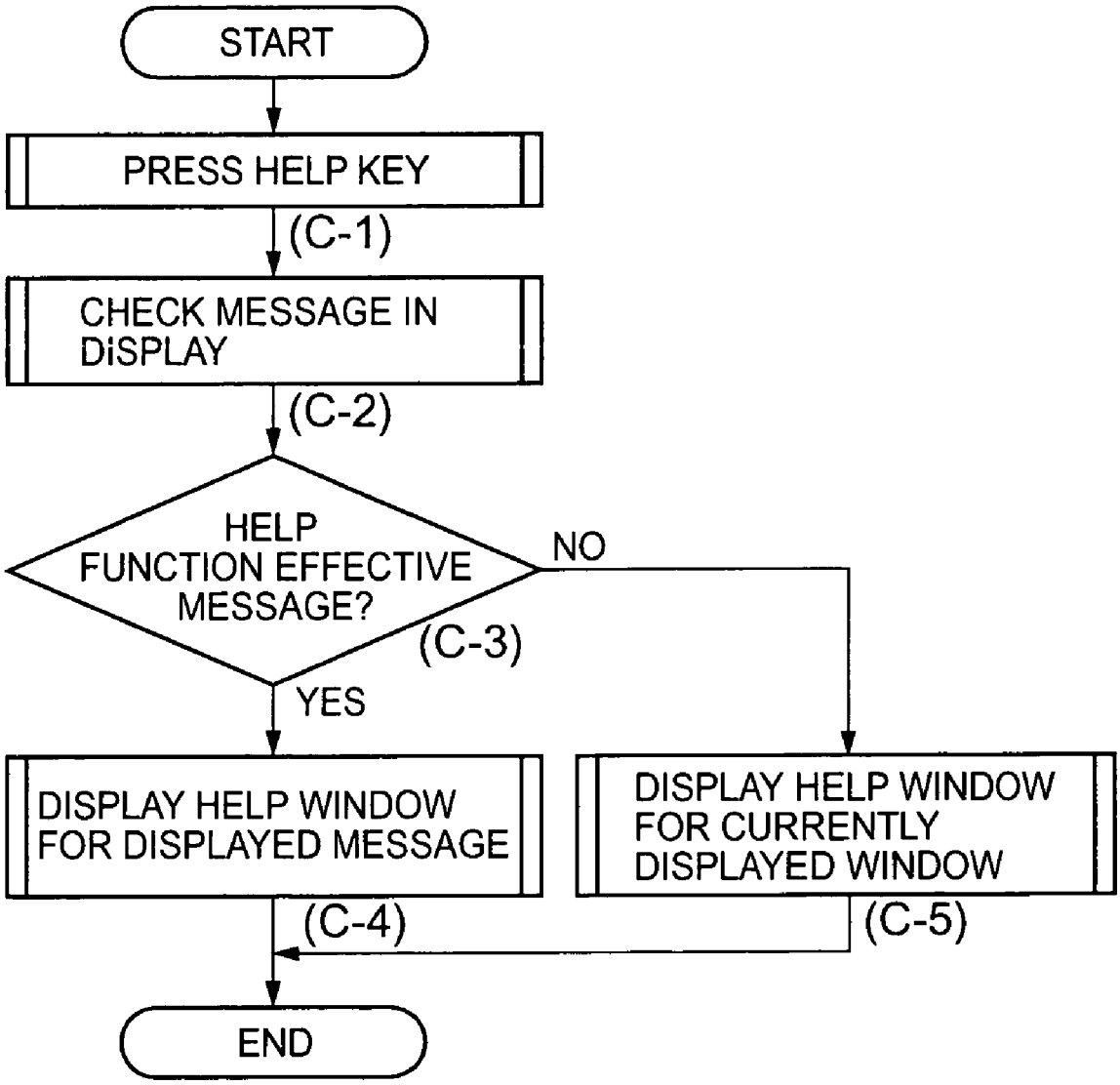
FIG. 7 is a flow chart showing still another example of the operation sequence for the help function processing in the image printing apparatus shown in FIG. 3.

FIG. 7 is a flow chart showing an example of the operation sequence of help function processing in the image printing apparatus 100 according to the embodiment shown in FIG. 3, which is an example still different from those shown in FIGS. 5 and 6.

The control unit 101 of the image printing apparatus 100 detects that the help key is pressed by the user on the operating unit 103 (C-1).

Upon detecting that the help key is pressed by the user, the control unit 101 checks the message currently displayed on the operation panel 115 of the operating unit 103 (C-2).

The control unit 101 checks whether the currently displayed message is a "help function effective message", i.e., whether a message for which a help window is stored in the storage unit 102 of the image printing apparatus 100 in advance in correspondence with the message is currently displayed (C-3).

If the "help function effective message" is currently displayed, a help window as an explanation of the currently displayed "help function effective message" is displayed on the operating unit 103 (C-4). The contents to be displayed may be stored in the storage unit 102 in advance to be read out as needed.

If the "help function effective message" is not currently displayed, a help window as an explanation of the currently displayed window is displayed on the operating unit 103 (C-5). The contents to be displayed in this case may also be stored in the storage unit 102 in advance to be read out as needed.

Specific examples of the display windows to be displayed by the help function of the image printing apparatus 100 of the present invention will be described next with reference to the accompanying drawings.

Figure 8:
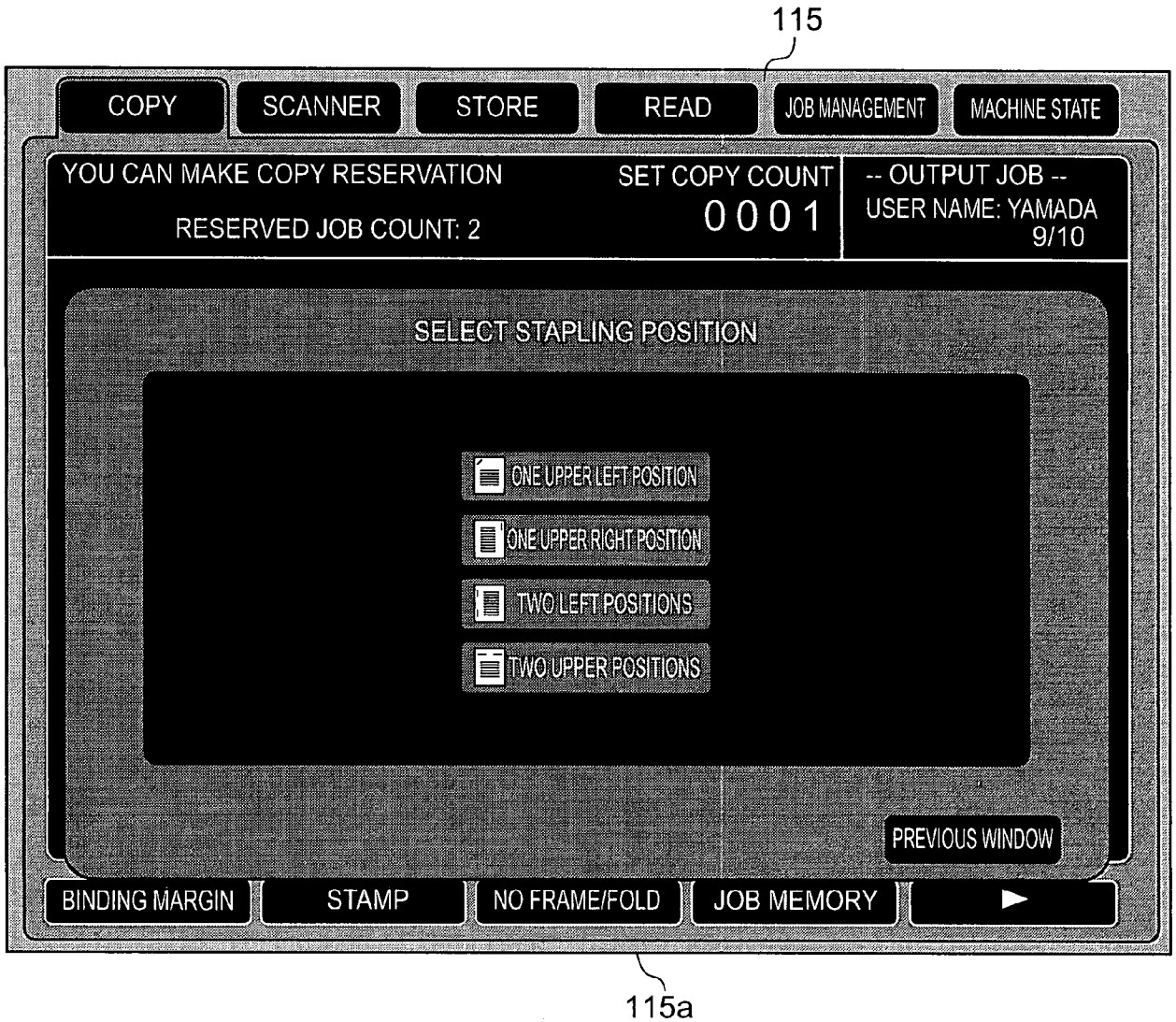
FIG. 8 is a view showing a display window for designating a stapling position as an example of display contents on an operation panel included in the operating unit of the image printing apparatus shown in FIG. 3.

FIG. 8 is a view showing an example of the contents displayed on the operation panel 115 included in the operating unit 103 of the image printing apparatus 100 in FIG. 3 and a view showing a window for designating a stapling position.

The operation panel 115 shown in FIG. 8 indicates an operation window for allowing the user to select a stapling position when he/she selects stapling processing by means of the postprocessing device 110 of the image printing apparatus 100.

In this specific example, a case will be described, in which the user has selected the designation of "two left positions", i.e., stapling documents at two left positions, by pressing a button 115*a* on the operation panel 115 in FIG. 8.

Figure 9:
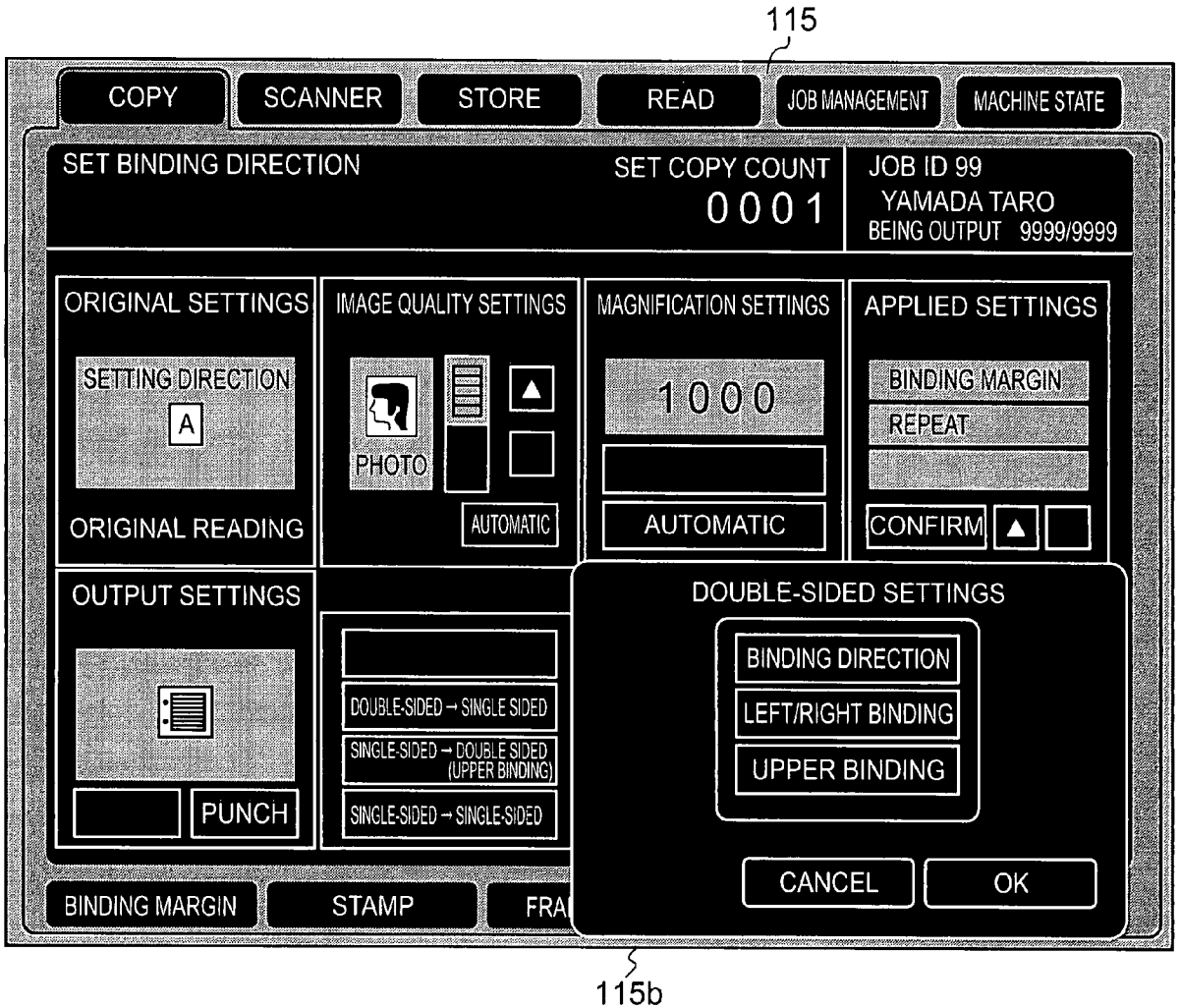
FIG. 9 is a view showing a display window for designating a binding direction in double-sided printing as an example of display contents on the operation panel included in the operating unit of the image printing apparatus shown in FIG. 3.

FIG. 9 is a view showing an example of the display contents on the operation panel 115 included in the operating unit 103 of the image printing apparatus 100 according to this embodiment shown in FIG. 3, and is a view showing a window for designating a binding direction in double-sided printing.

The operation panel 115 shown in FIG. 9 indicates an operation window for setting/selecting a binding direction in double-sided printing to determine a printing direction on the reverse surface of a sheet in accordance with the binding direction of documents on which images have been printed, when double-sided printing is performed by the image printing apparatus 100.

In this specific example, a case will be described, in which the user selects the designation of "upper binding", i.e., binding documents at the upper side, by pressing a button 115*b* on the operation panel 115 in FIG. 9 upon performing the operation in FIG. 8.

Figure 10:
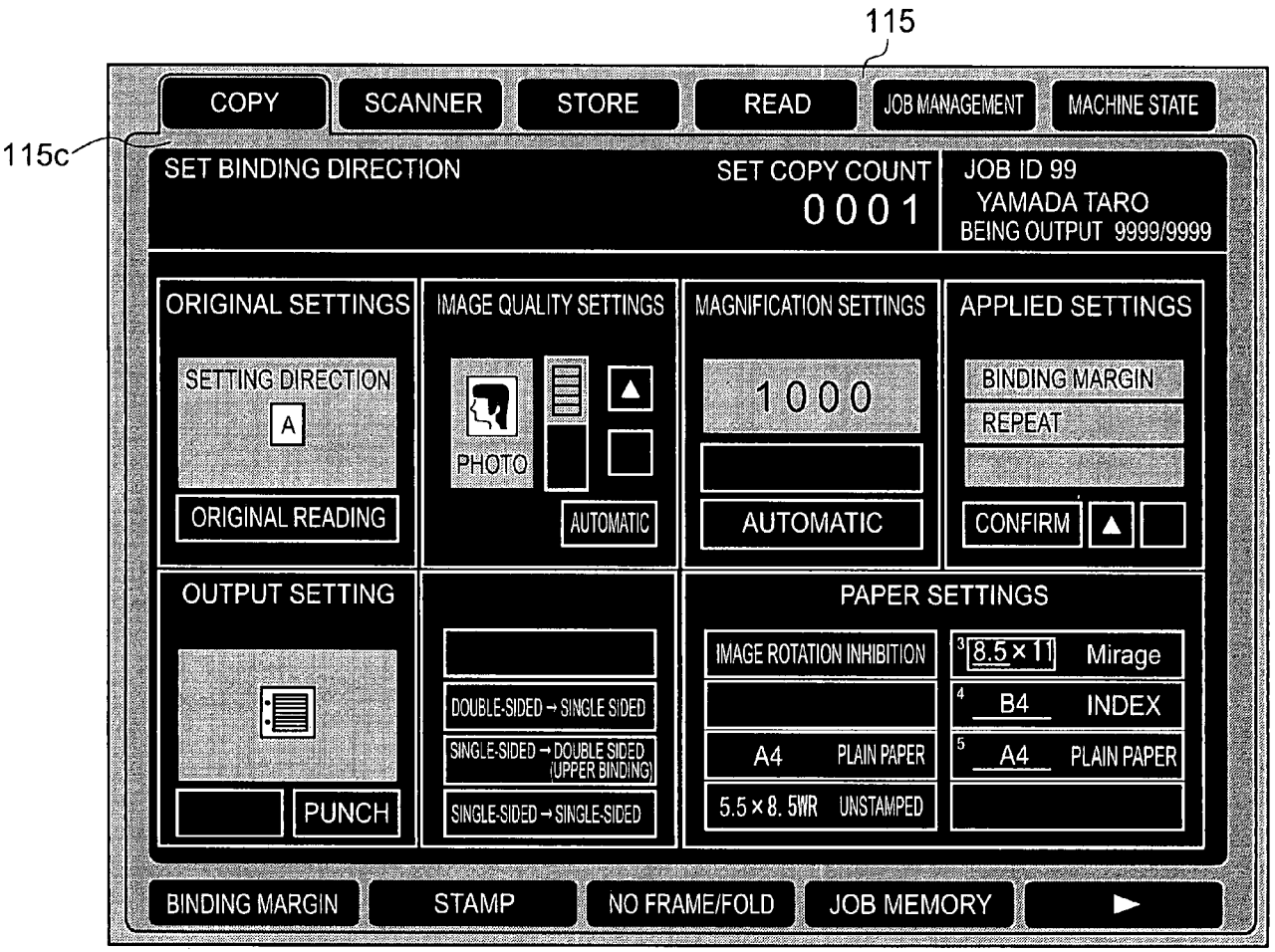
FIG. 10 is a view showing a display window to be displayed when the operation shown in FIGS. 8 or 9 is performed as an example of display contents on an operation panel included in the operating unit of the image printing apparatus shown in FIG. 3.

When the operations in FIGS. 8 and 9 are performed in this manner, the image printing apparatus 100 displays information like that shown in FIG. 10.

FIG. 10 is a view showing an example of the display contents on the operation panel 115 included in the operating unit 103 of the image printing apparatus 100 according to this embodiment shown in FIG. 3, and is a view showing a window to be displayed when the operations shown in FIGS. 8 and 9 are performed.

The message "Please change stapling position or binding direction" is displayed in a display area 115*c* on the operation panel 115 in FIG. 10. This is an example of a message for giving the user an operation instruction when image printing cannot be started because the designated stapling position does not match the designated binding direction.

With this display alone, the user may not understand the true meaning of the contents displayed in the display area 115*c* or may not know how to cope with the situation. In such a case, when the user presses the help key provided on the operating unit 103, the window switches to a display window like that shown in FIG. 11, and help information corresponding to the message displayed in the display area 115*c* is displayed.

Figure 11:
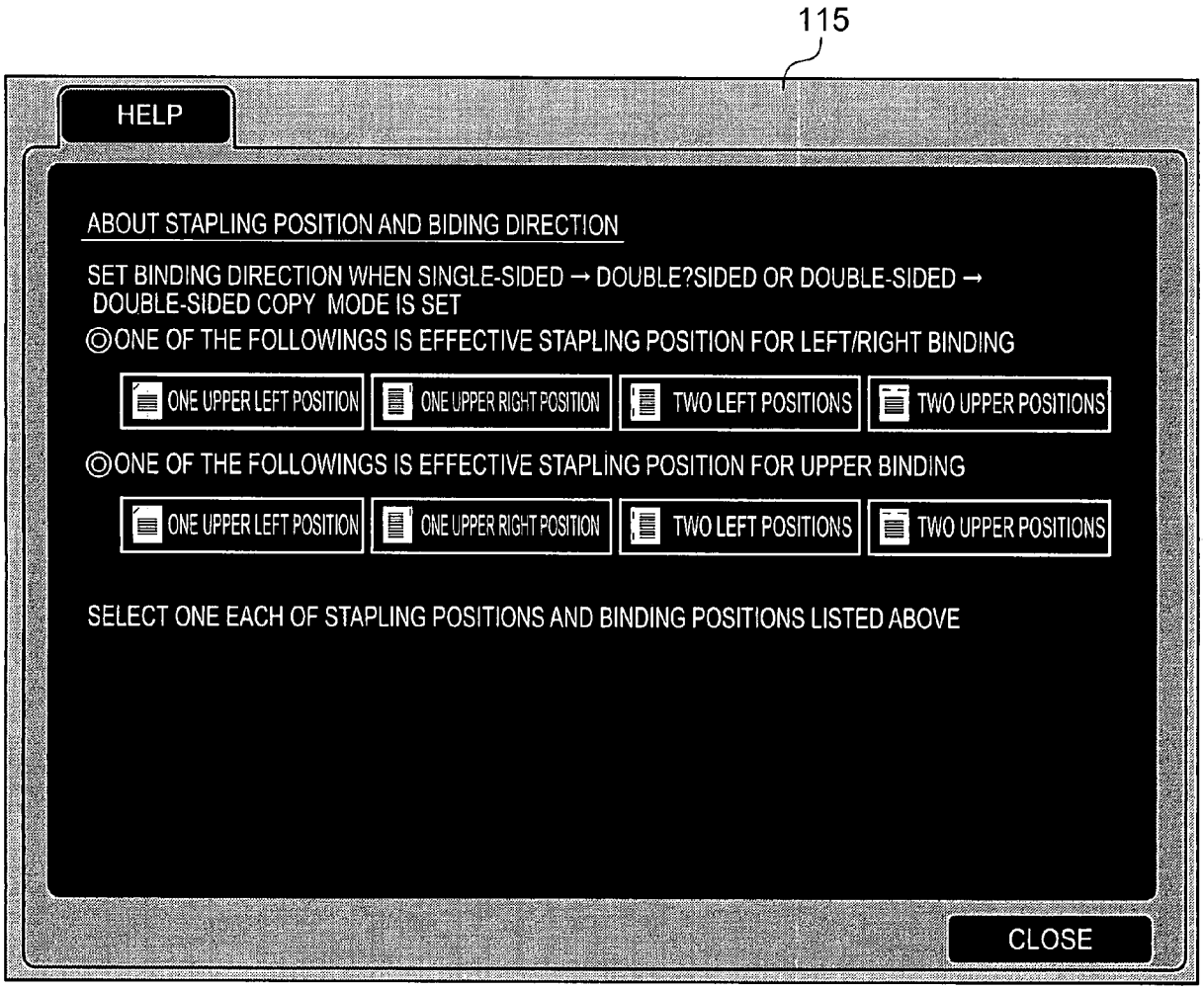
FIG. 11 is a view showing a display window to be displayed when the help key is pressed in the state in FIG. 10 as an example of display contents on an operation panel included in the operating unit of the image printing apparatus shown in FIG. 3.

FIG. 11 is a view showing an example of the display contents on the operation panel 115 included in the operating unit 103 of the image printing apparatus 100 of the present invention shown in FIG. 3, and is a view showing the display window to be displayed when the help key is pressed in the state shown in FIG. 10.

In the image printing apparatus 100, when "upper binding" is designated as shown in FIG. 9, an image is intentionally printed upside down on the reverse surface of each sheet so that the images on the obverse and reverse surfaces of each double-sided printed sheet can be easily read when the sheets are bound at the upper side. If, however, sheets are stapled at "two left positions" as in the case shown in FIG. 8, it is very difficult for the user to read the images printed on the obverse surfaces normally and printed on the reverse surfaces upside down. For this reason, the image printing apparatus 100 displays a message like the one displayed in the display area 115*c* shown in FIG. 10.

In such a situation, with the message in the display area 115*c* shown in FIG. 10 alone, the user may be confused as to what to do. In this embodiment, therefore, when the user presses the help key, a window like the one shown in FIG. 11 is displayed to give the user more detailed information.

As described above, according to this embodiment, the image printing apparatus 100 can display help information concerning a displayed message, thus providing more detailed information for the user.

Figure 12:
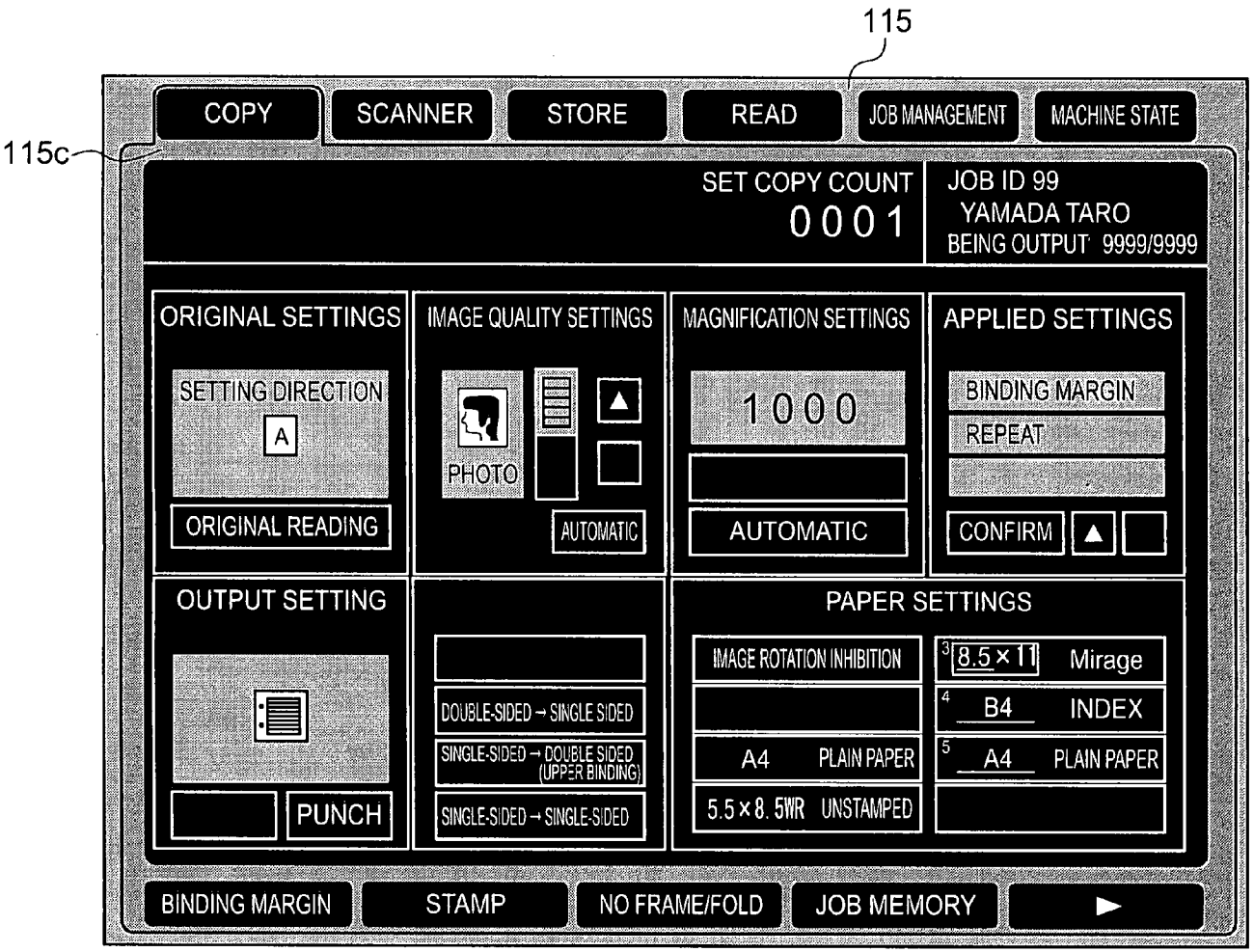
FIG. 12 is a view showing a display window to be displayed when the help key is pressed in the state in FIG. 10 as an example of display contents on an operation panel included in the operating unit of the image printing apparatus shown in FIG. 3.

If help windows are not prepared for all the display messages, it is preferable to allow the user to recognize a given message as a message for which a help window is prepared. FIG. 12 shows such a case.

In the case shown in FIG. 12, "Please change stapling position or binding direction" is displayed in the display area 115*c*, and "see HELP" is additionally written in the display area 115*c* to inform the user that this message is a message for which a help window is prepared. This is an embodiment of the above "identification information allowing the user to identify each of a plurality of messages displayed by the operating unit as a message for which whether or not the details of the message can be displayed by the help function. This makes it possible to clearly inform the user of the presence/absence of a help window.

Figure 13:
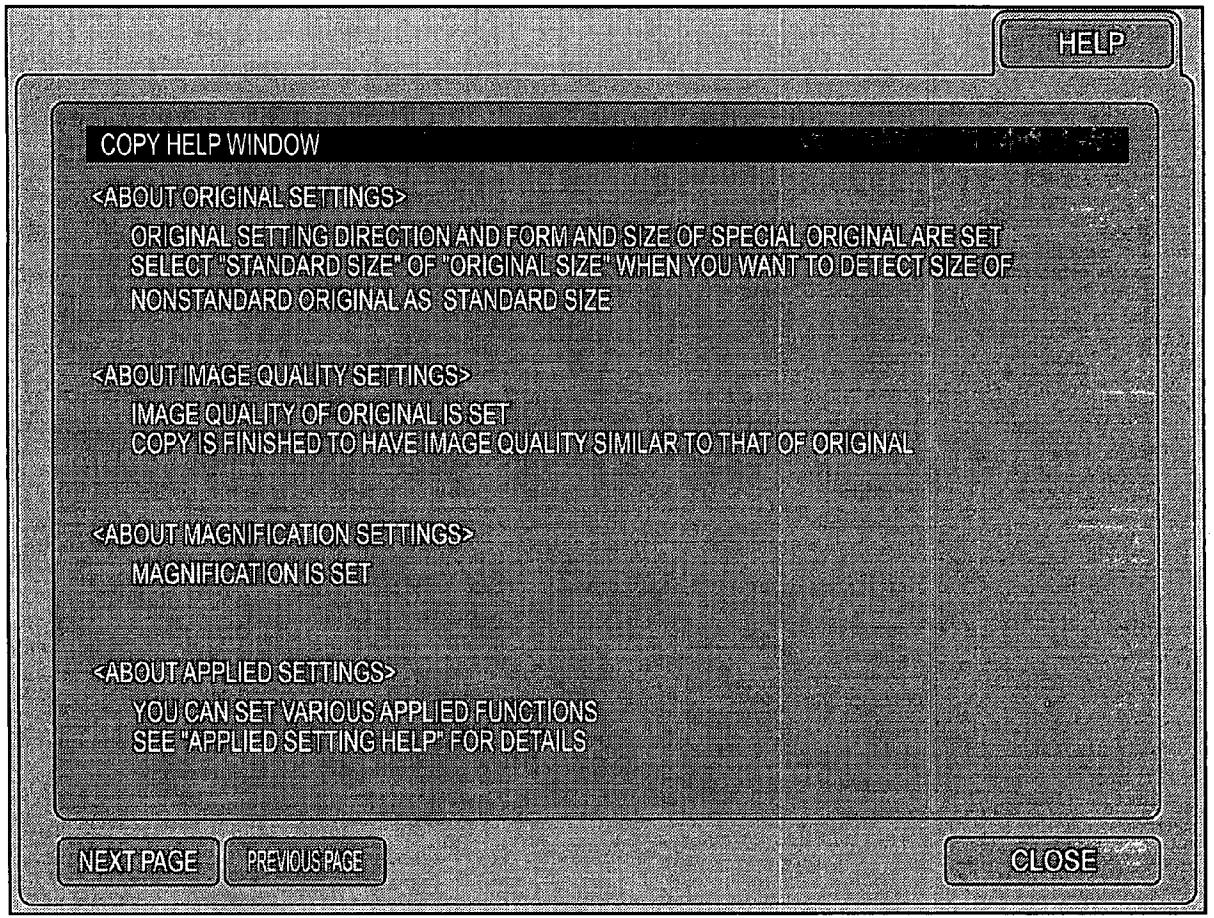
FIG. 13 is a view showing a display window concerning the detailed information of a currently displayed setting window when a message for which no help window is prepared is displayed.

If a given message is a message for which no help window is prepared, the message can be displayed without adding "see HELP", as shown in FIG. 10. When the help key is pressed while a message for which no help window is prepared is displayed, a help window as detailed information of the currently displayed setting window is preferably displayed, as shown in FIG. 13.

What is claimed is:

1. An image printing apparatus comprising:

an image forming section in which an image is formed based on image data;

a memory which stores at least one message and detailed information concerning at least one said message;

a display section which displays a displayed message, which is stored in the memory, and a setting window for setting at least one condition for formation of the image;

a control section which controls the display section; and an operating section including a help key which is operable by a user to instruct the display section to display a help message thereon;

wherein if the displayed message displayed by the display section corresponds to the detailed information, the display section displays identification information, which indicates that the detailed information corresponding to the displayed message is available for display, together with the displayed message;

wherein the control section causes the display section to display the detailed information of the displayed message as the help message if the help key is operated while the identification information is displayed on the display section; and wherein the control section causes the display section to display detailed information concerning the setting window as the help message if the help key is operated while the identification information is not displayed on the display section.

2. The image forming apparatus of claim 1, wherein the control section recognizes whether or not the detailed information concerning the displayed message is stored in said memory, when controlling said display section to display the displayed message.

3. The image forming apparatus of claim 2, wherein said memory stores correspondence information which indicates that the detailed information concerning the at least one message is stored in correspondence with the at least one message, and said control section recognizes whether or not the detailed information concerning the displayed message is stored in said memory based on the correspondence information.

4. The image forming apparatus of claim 2, wherein to display a help message, said control section changes display contents on said display section when said operating section is operated.

5. The image forming apparatus of claim 1, wherein said memory stores the detailed information concerning the setting window in correspondence with information concerning the setting window, and said control section recognizes whether or not the detailed information concerning the setting window is stored in said memory, when the help key is operated while the identification information is not displayed on said display section, and controls said display section to display the detailed information concerning the setting window, when it is recognized that the detailed information concerning the setting window is stored in said memory.

6. The image forming apparatus of claim 1, wherein the displayed message and the detailed information concerning the displayed message respectively comprise an operation instruction for the user and details of the operation instruction, and said control section controls said display section to display the details of the operation instruction when the help key is operated while the identification information is displayed together with the operation instruction on said display section.

7. The image forming apparatus of claim 1, wherein the displayed message and the detailed information concerning the displayed message respectively comprise a message stating that image printing cannot be started and details indicating that the image forming cannot be started, and said control section controls said display section to display the details indicating that the image forming cannot be started, when the help key is operated while the identification information is displayed together with the message stating that the image forming cannot be started on said display section.

8. An image printing apparatus comprising:

an image forming section in which an image is formed based on image data;

a memory which stores a first message for indicating that image formation cannot be started and detailed information concerning the first message;

a display section which displays the first message, when the image formation cannot be started, and a setting window for setting at least one condition for formation of the image;

a control section which controls the display section; and an operating section including a help key which is operable by a user to instruct the display section to display a help message thereon;

wherein when the help key is operated while the first message indicating that the image formation cannot be started is displayed on the display section, said control section controls said display section to display the detailed information concerning the first message as the help message, and when the help key is operated while the first message indicating that the image formation cannot be started is not displayed on said display section, said control section controls the display section to display detailed information concerning the setting window as the help message.

9. An image printing apparatus comprising:

an image forming section in which an image is formed based on image data;

a memory which stores a first message that includes an operating instruction for a user and detailed information concerning the operating instruction;

a display section which displays the first message and a setting window for setting at least one condition for formation of the image;

a control section which controls the display section; and an operating section including a help key which is operable by the user to instruct the display section to display a help message thereon;

wherein when the help key is operated while the first message that includes the operation instruction for the user is displayed on said display section, said control section controls the display section to display the detailed information of the operating instruction as the help message; and wherein when the help key is operated while the first message that includes the operation instruction is not displayed on the display section, the control section controls the display section to display detailed information concerning the setting window as the help message.

10. An image printing apparatus comprising:

an image forming section in which an image is formed based on image data;

a memory which stores at least one message and detailed information concerning at least one said message;

a display section which displays a displayed message, which is stored in the memory, and a setting window for setting at least one condition for formation of the image;

a control section which controls the display section; and an operating section including a help key which is operable by a user to instruct the display section to display a help message thereon;

wherein when the detailed information concerning the displayed message displayed on said display section is stored in said memory, said control section controls the display section to display the detailed information concerning the displayed message as the help message when the help key is operated, and wherein when no detailed information concerning the displayed message displayed on the display section is stored in the memory, the control section controls said display section to display detailed information concerning the setting window as the help message.

* * * * *